US005981156A

United States Patent [19]

Melpolder et al.

[11] Patent Number: 5,981,156

[45] Date of Patent: Nov. 9, 1999

[54] THERMALLY PROCESSABLE IMAGING ELEMENT

[75] Inventors: Sharon M. Melpolder, Hilton; Peter J. Cowdery-Corvan, Webster; Alfred J. Alton, Hilton, all of N.Y.

[73] Assignee: Eastman Kodak Company, Rochester, N.Y.

[21] Appl. No.: 08/915,209

[22] Filed: Aug. 20, 1997

[51] Int. Cl.[6] ..... G03C 1/76; G03C 1/498

[52] U.S. Cl. ..... 430/523; 430/600; 430/603; 430/611; 430/613; 430/617; 430/619; 430/631

[58] Field of Search ..... 430/617, 619, 430/631, 613, 600, 603, 611, 523

[56] References Cited

U.S. PATENT DOCUMENTS

| | | | |
|---|---|---|---|
| 3,080,254 | 3/1963 | Grant . | |
| 3,457,075 | 7/1969 | Morgan et al. . | |
| 3,933,508 | 1/1976 | Ohkubo et al. . | |
| 4,741,992 | 5/1988 | Przezdziecki . | |
| 4,828,971 | 5/1989 | Przezdziecki . | |
| 4,923,790 | 5/1990 | Kato et al. | 430/613 |
| 5,310,640 | 5/1994 | Markin et al. . | |
| 5,418,120 | 5/1995 | Bauer et al. | 430/619 |
| 5,547,821 | 8/1996 | Melpolder et al. . | |
| 5,750,328 | 5/1998 | Melpolder et al. | 430/619 |

OTHER PUBLICATIONS

*Research Disclosure*, Jun. 1978, Item No. 17029.

*Primary Examiner*—Thorl Chea
*Attorney, Agent, or Firm*—Edith A. Rice

[57] ABSTRACT

A method of making a thermally processable imaging element which comprises:

i) forming a solution of poly(vinyl alcohol) in water;

ii) adding matte particles to the resulting aqueous medium;

iii) adding a compound of the formula I or formula II to the aqueous medium in an amount sufficient to inhibit agglomeration of the matte particles:

(I)

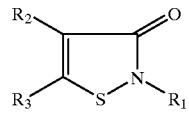

(II)

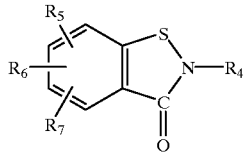

wherein: the substituents are as described in the specification;

iv) coating an image recording layer onto one side of a support;

v) coating the aqueous medium containing the matte particles as an overcoat layer over the image recording layer or as backing layer on the side of the support opposite the image recording layer.

29 Claims, No Drawings

THERMALLY PROCESSABLE IMAGING ELEMENT

FIELD OF THE INVENTION

This invention relates in general to imaging elements and their preparation, and in particular to thermally processable imaging elements. More specifically, this invention relates to imaging elements which comprise a thermographic or photothermographic layer and which contain matte particles in at least one layer thereof.

BACKGROUND OF THE INVENTION

Imaging elements form an image when imagewise exposed to light and/or heat and processed to form the desired final product. The term "imaging element" as used herein includes traditional silver halide photographic elements as well as thermally processable imaging elements. The invention is particularly directed to thermally processable imaging elements, but it is to be understood that the invention also relates to other imaging elements.

Thermally processable imaging elements, including films and papers, for producing images by thermal processing are well known. These elements include photothermographic elements in which an image is formed by imagewise exposure of the element to light followed by development by uniformly heating the element. These elements also include thermographic elements in which an image is formed by imagewise heating the element. Such elements are described in, for example, *Research Disclosure*, June 1978, Item No. 17029 and U.S. Pat. Nos. 3,080,254, 3,457,075 and 3,933, 508.

The aforesaid thermally processable imaging elements are often provided with a transparent or translucent overcoat and/or a transparent or translucent backing, with the overcoat being the outermost layer or layers on the side of the support on which the imaging layer is coated and the backing being the outermost layer or layers on the opposite side of the support. Other layers which are advantageously incorporated in thermally processable imaging elements include subbing layers, interlayers and barrier layers.

To be fully acceptable, a transparent or translucent protective layer (e.g., an overcoat or backing layer) for such imaging elements should: (a) provide resistance to deformation of the layers of the element during thermal processing, (b) prevent or reduce loss of volatile components in the element during thermal processing, (c) reduce or prevent transfer of essential imaging components from one or more of the layers of the element into the overcoat layer during manufacture of the element or during storage of the element prior to imaging and thermal processing, (d) enable satisfactory adhesion of the overcoat to a contiguous layer of the element, (e) be free from cracking and undesired marking, such as abrasion marking, during manufacture, storage, and processing of the element, (f) provide adequate conveyance characteristics during manufacture and processing of the element, (g) not allow blocking, adhering or slippage of the element during manufacture, storage, or processing, (h) not induce undesirable sensitometric effects in the element during manufacture, storage or processing, and (i) control the polarity and magnitude of charge on the surfaces of the element. during manufacture, storage, and processing of the element.

A backing layer also serves several important functions which improve the overall performance of thermally processable imaging elements. For example, a backing layer serves to improve conveyance, to reduce static charge, to provide the desired conductivity, reduce dirt and eliminate formation of Newton Rings.

A typical overcoat for thermally processable imaging elements is an overcoat comprising poly(silicic acid) as described in U.S. Pat. No. 4,741,992, issued May 3, 1988. Advantageously, water-soluble hydroxyl-containing monomers or polymers are incorporated in the overcoat layer together with the poly(silicic acid). The combination of poly(silicic acid) and a water-soluble hydroxyl-containing monomer or polymer that is compatible with the poly(silicic acid) is also useful in a backing layer on the side of the support opposite to the imaging layer as described in U.S. Pat. No. 4,828,971, issued May 9, 1989.

Particularly preferred overcoat and backing layers are described in U.S. Pat. Nos. 5,310,640 and 5,547,821, the entire disclosures of which are incorporated herein by reference.

U.S. Pat. No. 4,828,971 explains the requirements for backing layers in thermally processable imaging elements. It points out that an optimum backing layer must:

(a) provide adequate conveyance characteristics during manufacturing steps, (b) provide resistance to deformation of the element during thermal processing, (c) enable satisfactory adhesion of the backing layer to the support of the element without undesired removal during thermal processing, (d) be free from cracking and undesired marking, such as abrasion marking during manufacture, storage and processing of the element, (e) reduce static charging effects during manufacture and processing, (f) reduce dirt, (g) not provide undesired sensitometric effects in the element during manufacture, storage or processing and (h) provide desired conductivity.

With photothermographic elements, it is usually necessary to produce a "duplicate image" of the original photothermographic imaging element for low cost dissemination of the image. The duplication process is typically a "contact printing" process where intimate contact between the photothermographic imaging element and the duplication imaging element is essential. Successful duplication of either continuous rolls or cut sheets is dependent on adequate conveyance of the imaging element through the duplication equipment without the occurrence of slippage or sticking of the protective overcoat layer of the photothermographic imaging element in relation to any of (1) the duplication equipment, (2) the duplication imaging element or (3) the backing layer of subsequent portions of the photothermographic imaging element (adjacent convolutions of the photothermographic imaging element if in a continuous roll or adjacent "cut sheets" in a stacking configuration). These phenomena can include "blocking" and static charge buildup.

The addition of matte particles in the protective overcoat layers is commonly used to prevent adhering or "blocking" between the protective overcoat layer and adjacent backing layer with which it is in intimate contact during manufacture, storage, processing and photo duplication. Furthermore, the matte particles are necessary to impart anti-frictional characteristics to the protective overcoat and/or layer to achieve proper conveyance without sticking, blocking or slippage during the duplication process. The amount and particle size must be carefully controlled as the wrong particle size and/or amount can cause both conveyance, master and duplicate image quality problems.

PROBLEM TO BE SOLVED BY THE INVENTION

The photothermographic imaging element is typically viewed at magnification ratios as high as 100×. The matte particles in a protective layer (such as a protective overcoat or backing layer) if too large, can negatively alter or obscure the appearance of the image in the photothermographic imaging element layer when viewed at magnification larger than 1×. This altered image can further be transferred though the duplication process as well as a tertiary transformation of the image to paper through contact printing, electrophotographic processes, thermal printing or similar processes.

The matte particles are generally coated onto the imaging element from an aqueous medium containing a binder and matte particles. Particularly useful as a binder for imaging elements is poly(vinyl alcohol). However, it has been discovered that the matte particles tend to agglomerate when held in an aqueous medium containing poly(vinyl alcohol). Agglomerated matte particles can become so large they are easily visible under the magnification ratios typically used for thermally processed imaging elements. The agglomerated particles can obscure the image.

SUMMARY OF THE INVENTION

One aspect of this invention comprises a method of making a thermally processable imaging element comprising:

i) forming a solution of poly(vinyl alcohol) in water;

ii) adding a compound of formula I or formula II to the resulting aqueous medium in an amount sufficient to inhibit agglomeration of matte particles:

(I)

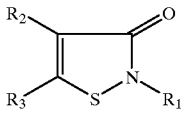

wherein:

$R_1$, represents a hydrogen atom, a straight or branched chain alkyl group, a cyclic alkyl group, an alkenyl group, an aralkyl group, an aryl group, a heterocyclic group an alkylamido group, an arylamido group, and alkylthioamido group, an arylamido group, an alkyl sulfamido group, an arylsulfamido group and $R_2$, and $R_3$, each independently represents a hydrogen atom, a halogen atom, an alkyl group, a cyclic alkyl group an aryl group, a cyano group, an alkylthio group, an aryl thio group, an alkylsulfoxide group an alkylsulfonyl group or a heterocyclic group;

(II)

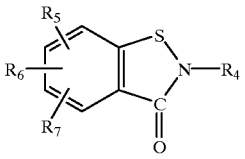

wherein:

$R_4$, is a hydrogen atom, an alkyl group or an alkoxy group; and $R_5$, $R_6$ and $R_7$ each represents a hydrogen atom, a halogen atom, an alkyl group, an alkoxy group, a cyano group or a nitro group;

iii) adding matte particles to the aqueous medium;

iv) coating an image recording layer onto one side of a support; and v) coating the aqueous medium containing the matte particles as an overcoat layer over the image recording layer or as backing layer on the side of the support opposite the image recording layer.

Another aspect of this invention comprises an imaging element comprising (1) a support;

(2) an image recording layer on one side of the support;

(3) a layer on the same side of the support as the image recording layer or on the opposite side of the support, said layer comprising:

(a) a poly(vinyl alcohol) binder;

(b) polymeric matte particles; and (c) a compound of formula I or formula II:

(I)

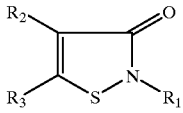

wherein:

$R_1$, represents a hydrogen atom, a straight or branched chain alkyl group, a cyclic alkyl group, an alkenyl group, an aralkyl group, an aryl group, a heterocyclic group an alkylamido group, an arylamido group, and alkylthioamido group, an arylamido group, an alkyl sulfamido group, an arylsulfamido group and $R_2$, and $R_3$, each independently represents a hydrogen atom, a halogen atom, an alkyl group, a cyclic alkyl group an aryl group, a cyano group, an alkylthio group, an aryl thio group, an alkylsulfoxide group an alkylsulfonyl group or a heterocyclic group;

(II)

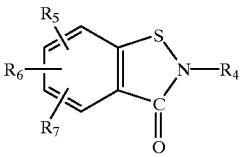

wherein:

$R_4$, is a hydrogen atom, an alkyl group or an alkoxy group; and $R_5$, $R_6$ and $R_7$ each represents a hydrogen atom, a halogen atom, an alkyl group, an alkoxy group, a cyano group or a nitro group.

Yet another aspect of this invention comprises a composition comprising:

(i) an aqueous medium comprising water and dissolved therein poly(vinyl alcohol); and (ii) polymeric matte particles dispersed in said aqueous medium; wherein the aqueous medium further comprises: (I)

(iii) a compound of formula I or formula II:

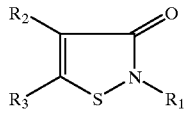

wherein:

$R_1$, represents a hydrogen atom, a straight or branched chain alkyl group, a cyclic alkyl group, an alkenyl group, an aralkyl group, an aryl group, a heterocyclic group an alkylamido group, an arylamido group, and alkylthioamido group, an arylamido group, an alkyl sulfamido group, an arylsulfamido group and $R_2$, and $R_3$, each independently represents a hydrogen atom, a halogen atom, an alkyl group, a cyclic alkyl group an aryl group, a cyano group, an alkylthio group, an aryl thio group, an alkylsulfoxide group an alkylsulfonyl group or a heterocyclic group;

(II)

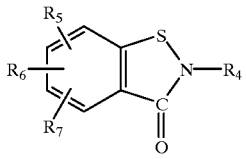

wherein:

$R_4$, is a hydrogen atom, an alkyl group or an alkoxy group; and $R_5$, $R_6$ and $R_7$ each represents a hydrogen atom, a halogen atom, an alkyl group, an alkoxy group, a cyano group or a nitro group.

ADVANTAGEOUS EFFECT OF THE INVENTION

This invention provides a thermally processable imaging element having a transparent or translucent protective layer containing matte particles in a poly(vinyl alcohol) binder. Agglomeration of matte particles in the binder is inhibited by the presence of a compound of formula (I) or (II) in the aqueous medium used to make the imaging element.

DETAILED DESCRIPTION OF THE INVENTION

In the preparation of an imaging element in which one layer contains matte particles and polyvinyl alcohol, the polyvinyl alcohol is dissolved in water and matte particles are added to the solution. To inhibit agglomeration of the matte particles in the poly(vinyl alcohol) solution, a compound of formula I or a compound of formula II, below, is added to the poly(vinyl alcohol) solution:

(I)

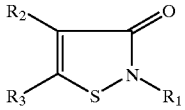

wherein:

$R_1$, represents a hydrogen atom, a straight or branched chain alkyl group, a cyclic alkyl group, an alkenyl group, an aralkyl group, an aryl group, a heterocyclic group an alkylamido group, an arylamido group, and alkylthioamido group, an arylamido group, an alkyl sulfamido group, an arylsulfamido group and $R_2$, and $R_3$, each independently represents a hydrogen atom, a halogen atom, an alkyl group, a cyclic alkyl group an aryl group, a cyano group, an alkylthio group, an aryl thio group, an alkylsulfoxide group an alkylsulfonyl group or a heterocyclic group;

(II)

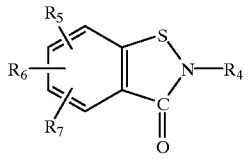

wherein:

$R_4$, is a hydrogen atom, an alkyl group or an alkoxy group; and $R_5$, $R_6$ and $R_7$ each represents a hydrogen atom, a halogen atom, an alkyl group, an alkoxy group, a cyano group or a nitro group.

Particularly preferred are compounds of formula I having the structures Ia or Ib:

(Ia)

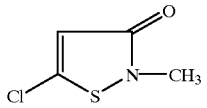

(Ib)

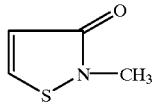

Preferably a mixture of compounds Ia and Ib are used. Preferably the ratio between the compound Ia and the compound of formula Ib is 50:50 to 90:10. In particularly preferred embodiments of the invention the ratio between the compound of formula Ia and compound Ib is 75:25.

The amount of a compound of formula I or formula II used in the poly(vinyl alcohol) composition is an amount sufficient to inhibit agglomeration of the matte particles. The compound of formula I or formula II is preferably present in an amount of about 1 to about 1500 ppm, relative to the amount of poly(vinyl alcohol), more preferably about 1 to about 1000 and most preferably about 10 to about 15.

While not wishing to be bound by any theory, it is believed that the addition of a compound of formula I or II inhibits the growth of microorganisms in the poly(vinyl alcohol) solution, which in turn inhibits the agglomeration of matte particles. The exact mechanism by which agglomeration is inhibited is not fully understood. However, we have unexpectedly discovered that the addition of a compound of formula I or formula II inhibits agglomeration of matte particles when they are added to an aqueous medium containing poly(vinyl alcohol).

In accordance with this invention, an imaging element is provided with an outer transparent or translucent protective layer containing matte particles in a binder comprising poly(vinyl alcohol). As mentioned above, the imaging element can be a photographic element. In preferred embodiments of the invention the imaging element is a thermographic or photothermographic element. The imaging element is provided with a transparent or translucent protective layer comprising a film forming binder comprising poly(vinyl alcohol). The binder typically comprises about 30 to about 100 percent poly(vinyl alcohol). In preferred embodiments of the invention, the binder also contains poly(silicic acid) in addition to poly(vinyl alcohol). The binder preferably contains about 30 to about 80 percent poly(silicic acid). These percentages are by weight, based on the total dry weight of the binder.

The term "protective layer" is used in this application to mean a transparent or translucent, image insensitive layer containing matte particles. The protective layer can be an overcoat layer, that is a layer that overlies the image sensitive layer(s), or a backing layer, that is a layer that is on the opposite side of the support from the image sensitive layer (s). The imaging element can have a protective overcoat layer and/or a protective backing layer and/or an adhesive interlayer. The protective layer is not necessarily the outermost layer of the imaging element.

Poly(vinyl alcohol) is formed by hydrolysis of poly(vinyl acetate). Poly(vinyl alcohol) prior to use is soluble in water and available in powder or pellet form. The more fully hydrolyzed poly(vinyl alcohol)s have higher water and humidity resistance. The molecular weight average may vary between above about 13,000 and up to about 200,000. Poly(vinyl alcohol) is commercially available from several manufacturers in various grades. The exact type of poly (vinyl alcohol) used in this invention is not critical and any poly(vinyl alcohol) can be used.

A wide variety of materials can be used to prepare a backing layer that is compatible with the requirements of thermally processable imaging elements. The backing layer should be transparent or translucent and should not adversely affect the sensitometric characteristics of the photothermographic element such as minimum density, maximum density and photographic speed. Useful backing layers include those comprised of poly(silicic acid) and a water-soluble hydroxyl containing monomer or polymer that is compatible with a poly(silicic acid) as described in U.S. Pat. No. 4,828,971. A combination of poly(silicic acid) and poly(vinyl alcohol) is particularly useful. Other useful backing layers include those formed from polymethylmethacrylate, acrylamide polymers, cellulose acetate, crosslinked poly(vinyl alcohol), terpolymers of acrylonitrile, vinylidene chloride, and 2-(methacryloyloxy) ethyl-trimethylammonium methosulfate, crosslinked or uncrosslinked gelatin, polyesters, polyurethanes and mixtures thereof.

Particularly preferred backing layers are described in above-mentioned U.S. Pat. Nos. 5,310,640 and 5,547,821, the entire disclosures of which are incorporated herein by reference. As taught in the '640 patent a preferred thermographic or photothermographic imaging element comprises:

(1) a support;

(2) a thermographic or photothermographic imaging layer on one side of said support;

(3) a backing layer which is an outermost layer and is located on the side of said support opposite to said imaging layer, said backing layer comprising a binder and matte particles dispersed therein; and (4) an electroconductive layer which is an inner layer and is located on either side of said support, said electroconductive layer having an internal resistivity of less than or equal to $5\times10^{10}$ ohms/square.

The backing layer is transparent or translucent and contains organic or inorganic matte particles. In the '640 patent the matte particles are preferably particles of poly (methylmethacrylate-co-ethyleneglycoldimethacrylate). The electroconductive layer preferably comprises a colloidal gel of silver-doped vanadium pentoxide dispersed in a polymeric binder.

As taught in the '821 patent a preferred thermographic or photothermographic imaging element comprises:

(1) a support;

(2) a thermographic or photothermographic imaging layer on one side of said support;

(3) a non-electroconductive transparent or translucent overcoat layer which is an outermost layer on the same side of said support as said imaging layer; and (4) an electroconductive transparent or translucent backing layer which is an outermost layer located on the side of said support opposite to said imaging layer;

said electroconductive backing layer comprising a polymeric binder, matte particles and electrically-conductive metal-containing particles dispersed in said binder in an amount sufficient to provide a surface resistivity of less than or equal to $5\times10^{11}$ ohms/square.

In certain embodiments of the invention, the protective layer is a backing layer which preferably has a glass transition temperature (Tg) of greater than 50° C., more preferably greater than 100° C., and a surface roughness such that the Roughness Average (Ra) value is greater than 0.8, more preferably greater than 1.2, and most preferably greater than 1.5.

As described in U.S. Pat. No. 4,828,971, the entire disclosure of which is incorporated herein by reference, the Roughness Average (Ra) is the arithmetic average of all departures of the roughness profile from the mean line. As described in Markin et al, U.S. Pat. No. 5,310,640, the entire disclosure of which is incorporated herein by reference, particularly advantageous thermally processable imaging elements include both a backing layer and an electroconductive layer which serves as an antistatic layer.

The protective layer utilized in the thermally processable imaging elements of this invention performs several important functions as herein above described for overcoat and/or backing layers. It can be composed of hydrophilic colloids such as gelatin or poly(vinyl alcohol) but is preferably composed of poly(silicic acid) and a water-soluble hydroxyl-containing monomer or polymer as described in U.S. Pat. No. 4,741,992, issued May 3, 1988.

The protective layer also contains matte particles. Either organic or inorganic matte particles can be used. Examples of organic matte particles are often in the form of particles, of polymers such as polymeric esters of acrylic and methacrylic acid, e.g., poly(methylmethacrylate), styrene polymers and copolymers, and the like. Examples of inorganic matte particles are of glass, silicon dioxide, titanium dioxide, magnesium oxide, aluminum oxide, barium sulfate, calcium carbonate, and the like. Matte particles and their preparation are discussed more fully below.

The matte particles utilized in this invention can be incorporated in any layer of the thermally processable element but are preferably included in a protective layer and in particular a protective overcoat layer which is preferably an outermost layer on the same side of the support as the image recording layer(s) and are preferably disposed so that they protrude slightly above the surface of such overcoat layer. In other embodiments of the invention, the matte particles can be incorporated in a protective layer which is a protective backing layer on the opposite side of the support than the image recording layer and the way they are used are further described in U.S. Pat. Nos. 3,411,907 and 3,754,924, the entire disclosures of which are incorporated herein by reference.

The matte particles utilized in this invention preferably have a mean diameter in the range of from about 0.5 to about 10 micrometers, more preferably in the range of from about 0.5 to about 7 micrometers and most preferably in the range of from about 0.6 to about 5 micrometers. They are preferably utilized in an amount of from about 5 to about 200 $mg/m^2$ and more preferably from about 20 to about 125 $mg/m^2$. The mean diameter is defined as the mean of the volume distribution.

The matte particles which are especially useful in this invention are organic polymers that can be prepared by:

pulverizing and classification of organic compounds, emulsion, suspension, and dispersion polymerization of organic monomers, spray drying of a solution containing organic compounds, and polymer suspension technique which consists of dissolving an organic material in a water immiscible solvent, dispersing the solution as fine liquid droplets in aqueous solution, and removing the solvent by evaporation or other suitable techniques. The bulk, emulsion, dispersion, and suspension polymerization procedures are well known to those skilled in the polymer art and are taught in such textbook as G. Odian in "Principles of Polymerization", 2nd Ed. Wiley (1981), and W. P. Sorenson and T. W. Campbell in "Preparation Method of Polymer Chemistry", 2nd Ed, Wiley (1968).

The particle surface may be surrounded with a layer of colloidal inorganic particles as described in U.S. Pat. Nos. 5,288,598, and 5,378,577 and in commonly assigned copending application Ser. No. 08/421,178, filed Apr. 13, 1995, or a layer of colloidal polymer latex particles which have affinity with suitable binder as described in U.S. Pat. No. 5,279,934, or a layer of gelatin as described in U.S. Pat. No. 4,855,219, or may be polymerized in the presence of gelatin per U.S. Pat. No. 5,563,226, all of which are incorporated herein by reference. Particularly preferred are matte particles comprising poly(methyl methacrylate) polymerized in the presence of gelatin.

A preferred method of preparing matte particles in accordance with this invention is by a limited coalescence technique where polymerizable monomer or monomers are added to an aqueous medium containing a particulate suspending agent to form a discontinuous (oil droplet) phase in a continuous (water) phase. The mixture is subjected to shearing forces, by agitation, homogenization and the like to reduce the size of the droplets. After shearing is stopped an equilibrium is reached with respect to the size of the droplets as a result of the stabilizing action of the particulate suspending agent in coating the surface of the droplets and then polymerization is completed to form an aqueous suspension of polymer particles. This process is described in U.S. Pat. Nos. 2,932,629; 5,279,934; and 5,378,577 incorporated herein by reference.

As described in the '577 patent and '878 application, any suitable colloidal inorganic particles can be used to form the particulate layer on the polymeric core, such as, for example, silica, alumina, alumina-silica, tin oxide, titanium dioxide, zinc oxide and the like. Colloidal silica is preferred for several reasons including ease of preparation of the coated polymeric particles and narrow size distribution. For the purpose of simplification of the presentation of this invention, throughout the remainder of this specification colloidal silica will be used as the "colloidal inorganic particles" surrounding the polymeric core material, however, it should be understood that any of the colloidal inorganic particles may be employed.

A second preferred method of preparing matte particles in accordance with this invention is by a process including forming a suspension or dispersion of ethylenically unsaturated monomer droplets in an aqueous media, subsequent to the formation of the droplets and before the commencement of the polymerization reaction, adding to the aqueous media an effective amount of a hydrophilic colloid such as gelatin and polymerizing the monomer to form solid polymer particles.

Any suitable polymeric material or mixture of polymeric materials capable of being formed into particles having the desired size may be employed in the practice of this invention to prepare matte particles for use in thermally processable elements, such as, for example, olefin homopolymers and copolymers, such as polyethylene, polypropylene, polyisobutylene, polyisopentylene and the like; polyfluoroolefins such as polytetrafluoroethylene, polyvinylidene fluoride and the like, polyamides, such as, polyhexamethylene adipamide, polyhexamethylene sebacamide and polycaprolactam and the like; acrylic resins, such as polymethylmethacrylate, polyacrylonitrile, polymethylacrylate, polyethylmethacrylate and styrene-methylmethacrylate or ethylene-methyl acrylate copolymers, ethylene-ethyl acrylate copolymers, ethylene-ethyl methacrylate copolymers, polystyrene and copolymers of styrene with unsaturated monomers, polyvinyltoluene, cellulose derivatives, such as cellulose acetate, cellulose acetate butyrate, cellulose propionate, cellulose acetate propionate, and ethyl cellulose; polyvinyl resins such as polyvinyl chloride, copolymers of vinyl chloride and vinyl acetate and polyvinyl butyral, poly(vinyl alcohol), polyvinyl acetal, ethylene-vinyl acetate copolymers, ethylene-vinyl alcohol copolymers, and ethylene-allyl copolymers such as ethylene-allyl alcohol copolymers, ethylene-allyl acetone copolymers, ethylene-allyl benzene copolymers ethylene-allyl ether copolymers, ethylene-acrylic copolymers and polyoxy-methylene, polycondensation polymers, such as, polyesters, including polyethylene terephthalate, polybutylene terephthalate, polyurethanes and polycarbonates.

If desired, a suitable crosslinking monomer may be used in forming polymer particles by polymerizing a monomer or monomers within droplets to thereby modify the polymeric particle and produce particularly desired properties. Typical crosslinking monomers are aromatic divinyl compounds such as divinylbenzene, divinylnaphthalene or derivatives thereof; diethylene carboxylate esters and amides such as diethylene glycol bis(methacrylate), diethylene glycol diacrylate, and other divinyl compounds such as divinyl sulfide or divinyl sulfone compounds. Styrene, vinyl toluene or methyl methacrylate, as homopolymers, copolymers or crosslinked polymers, are preferred. Vinyl toluene crosslinked with divinylbenzene is especially preferred.

A still further method of preparing matte particles in accordance with this invention is the "polymer suspension" technique, a suitable polymer is dissolved in a solvent and this solution is dispersed as fine water-immiscible liquid droplets in an aqueous solution that contains colloidal silica as a stabilizer. Equilibrium is reached and the size of the droplets is stabilized by the action of the colloidal silica coating the surface of the droplets. The solvent is removed from the droplets by evaporation or other suitable technique resulting in polymeric particles having a uniform coating thereon of colloidal silica. This process is further described in U.S. Pat. No. 4,833,060 issued May 23, 1989, assigned to the same assignee as this application and herein incorporated by reference.

Useful solvents for the polymer suspension process are those that dissolve the polymer, which are immiscible with water and which are readily removed from the polymer droplets such as, for example, chloromethane, dichloromethane, ethylacetate, n-propyl acetate, vinyl chloride, methyl ethyl ketone, trichloromethane, carbon tetrachloride, ethylene chloride, trichloroethane, toluene, xylene, cyclohexanone, 2-nitropropane and the like. Particularly useful solvents are dichloromethane, ethyl acetate and n-propyl acetate because they are good solvents for many polymers while at the same time, they are immiscible with water. Further, their volatility is such that they can be readily removed from the discontinuous phase droplets by evaporation.

The quantities of the various ingredients and their relationship to each other in the polymer suspension process can vary over wide ranges, however, it has generally been found that the ratio of the polymer to the solvent should vary in an amount of from about 1 to about 80% by weight of the combined weight of the polymer and the solvent and that the combined weight of the polymer and the solvent should vary with respect to the quantity of water employed in an amount of from about 25 to about 50% by weight. The size and quantity of the colloidal silica stabilizer depends upon the size of the particles of the colloidal silica and also upon the size of the polymer droplet particles desired. Thus, as the size of the polymer/solvent droplets are made smaller by high shear agitation, the quantity of solid colloidal stabilizer is varied to prevent uncontrolled coalescence of the droplets and to achieve uniform size and narrow size distribution of the polymer particles that result. The suspension polymerization technique and the polymer suspension technique herein described are the preferred methods of preparing the matte particles having a uniform layer of colloidal silica thereon for use in the preparation of thermally processable elements in accordance with this invention. These techniques provide particles having a predetermined average diameter anywhere within the range of from 0.5 micrometer to about 150 micrometers with a very narrow size distribution and therefore can be used to prepare matte particles. The coefficient of variation (ratio of the standard deviation) to the average diameter, as described in U.S. Pat. No. 2,932,629, referenced previously herein, are normally in the range of about 15 to 35%.

When making matte particles for use in this invention, it is sometimes desirable to incorporate a non-reactive hydrophobic additive, for example, as described in U.S. Pat. Nos. 5,455,320, 5,492,960 and commonly assigned copending application Ser. No. 08/631,878, filed Apr. 13, 1995, the entire disclosures of which are incorporated herein by reference. This method is particularly suitable for making polymeric particles where uniform size and size distribution, with minimal oversized particles, are a consideration such as photothermographic matte particles.

The nonreactive compound will have a solubility in water less than that of the ethylenically unsaturated monomer. Where more than one ethylenically unsaturated monomer is employed, as in the preparation of a copolymer, the nonreactive compound will have a solubility in water less than that of the least soluble monomer. Stated another way, the nonreactive compound is more hydrophobic than the most hydrophobic ethylenically unsaturated monomer in the monomer droplets. A convenient manner of defining the hydrophobicity of materials is by calculating the log of the octanol/water partition coefficient ($\log P_{(calc)}$), the higher the numerical value, the more hydrophobic is the compound. Thus, the nonreactive compound will have a $\log P_{(calc)}$ greater than the $\log P_{(calc)}$ of the most hydrophobic ethylenically unsaturated monomer present. Preferably, the difference in $\log P_{(calc)}$ of the monomer and the nonreactive compound (D $\log P_{(calc)}$) should be at least 1 and most preferably at least 3 to achieve the most uniform particle size with the lowest values for particle size distribution.

As described in the '878 application, a nonreactive hydrophobic compound is present in the ethylenically unsaturated monomer droplets (discontinuous phase); however, the hydrophobic compound can be added initially either to the monomer phase before addition of the water or continuous phase, which is preferred, or to the water phase either before or after the two phases are added together but before the mixture is subjected to shearing forces. While not being bound by a particular theory or mechanism, it is believed that oversized particles are formed by diffusion of monomers prior to or during polymerization and that the hydrophobic additive prevents or reduces the rate of diffusion, and thereby reduces the formation of larger particles.

As indicated above, the nonreactive compound is more hydrophobic than the monomer and has a higher $\log P_{(calc)}$ than the monomer. $\mathrm{Log}P_{(calc)}$ is the logarithm of the value of the octanol/water partition coefficient (P) of the compound calculated using MedChem, version 3.54, a software package available from the Medicinal Chemistry Project, Pomona College, Claremont, Calif. $\mathrm{Log}P_{(calc)}$ is a parameter which is highly correlated with measured water solubility for compounds spanning a wide range of hydrophobicity. $\mathrm{Log}P_{(calc)}$ is a useful means to characterize the hydrophobicity of compounds. The nonreactive compounds used in this invention are either liquid or oil soluble solids and have a $\log P_{(calc)}$ greater than any of the ethylenically unsaturated monomers present. Suitable nonreactive, hydrophobic compounds are those selected from the following classes of compounds:

I. Saturated and unsaturated hydrocarbons and halogenated hydrocarbons, including alkanes, alkenes, alkyl and alkenyl halides, alkyl and alkenyl aromatic compounds, and halogenated alkyl and alkenyl aromatic compounds, especially those having a $\log P_{calc}$ greater than about 3, II. alcohols, ethers, and carboxylic acids containing a total of about 10 or more carbon atoms, especially those having a $\log P_{calc}$ greater than about 3, III. esters of saturated, unsaturated, or aromatic carboxylic acids containing a total of about 10 or more carbon atoms, especially those having a $\log P_{calc}$ greater than about 3, IV. amides of carboxylic acids having a total of 10 or more carbon atoms, especially those having a $\log P_{calc}$ greater than about 3, V. esters and amides of phosphorus- and sulfur-containing acids having a $\log P_{calc}$ greater than about 3, and other compounds of similar hydrophobicity.

Compounds of Class I include: straight or branched chain alkanes such as, for example, hexane, octane, decane, dodecane, tetradecane, hexadecane, octadecane, 2,2,6,6,9,9-hexamethyldodecane, eicosane, or triacontane; alkenes such as, for example, heptene, octene, or octadecene; substituted aromatic compounds such as, for example, octylbenzene, nonylbenzene, dodecylbenzene, or 1,1,3,3-tetramethylbutylbenzene; haloalkanes such as, for example, heptyl chloride, octyl chloride, 1,1,1-trichlorohexane, hexyl bromide, 1,11-dibromoundecane, and halogenated alkyl aromatic compounds such as, for example, p-chlorohexylbenzene and the like.

Compounds of Class II include: decanol, undecanol, dodecanol, hexadecanol, stearyl alcohol, oleyl alcohol, eicosanol, di-t-amyl phenol, p-dodecylphenol, and the like; lauric acid, tetradecanoic acid, stearic acid, oleic acid, and the like; methyldodecylether, dihexyl ether, phenoxytoluene, and phenyldodecyl ether; and the like.

Compounds of Class III include: methyl laurate, butyl laurate, methyl oleate, butyl oleate, methyl stearate, isopropyl palmitate, isopropyl stearate, tributyl citrate, acetyl tributyl citrate, 3-(4-hydroxy-3,5-di-t-butylphenyl)propionic octadecyl ester (commercially available under the trademark Irganox 1076), 2-ethylhexyl-p-hydroxylbenzoate, phenethyl benzoate, dibutyl phthalate, dioctyl phthalate, dioctyl terephthalate, bis(2-ethylhexyl) phthalate, butyl benzyl phthalate, diphenyl phthalate, dibutyl sebacate, didecyl succinate, and bis(2-ethylhexyl) azelate and the like.

Compounds of Class IV include: lauramide, N-methyllauramide, N,N-dimethyllauramide, N,N-dibutyllauramide, N-decyl-N-methylacetamide, and N-oleylphthalimide and the like.

Compounds of Class V include, for example, sulfates, sulfonates, sulfonamides, sulfoxides, phosphates, phosphonates, phosphinates, phosphites, or phosphine oxides. Particular examples include diesters of sulfuric acid, such as, for example, dihexylsulfate, didecylsulfate, and didodecylsulfate; esters of various alkyl sulfuric acids including, for example, methyl decanesulfonate, octyl dodecanesulfonate, and octyl p-toluenesulfonate; sulfoxides, including, for example, bis(2-ethylhexyl) sulfoxide; and sulfonamides, including, for example, N-(2-ethyhexyl)-p-toluenesulfonamide, N-hexadecyl-p-toluenesulfonamide, and N-methyl-N-dodecyl-p-toluesulfonamide. Phosphorus-containing compounds include, for example, triesters of phosphoric acid such as, for example, triphenyl phosphate, tritolylphosphate, trihexylphosphate, and tris(2-ethylhexyl)phosphate; various phosphonic acid esters, such as, for example, dihexyl hexylphosphonate, and dihexyl phenylphosphonate; phosphite esters such as tritolylphosphite, and phosphine oxides such as trioctylphosphine oxide.

Representatives compounds are given below, along with their $\log P_{calc}$ value, calculated using the above-mentioned MedChem software package (version 3.54). This software package is well-known and accepted in the chemical and pharmaceutical industries.

| | $\log P_{calc}$ |
|---|---|
| Nonreactive Compound | |
| hexane | 3.87 |
| octane | 4.93 |
| decane | 5.98 |
| dodecane | 7.04 |
| hexadecane | 9.16 |
| dimethylphthalate | 1.36 |
| dibutylphthalate | 4.69 |
| bis(2-ethylhexyl)phthalate | 8.66 |
| dioctylphthalate | 8.92 |
| tritolylphosphate | 6.58 |
| tris(2-ethylhexyl)phosphate | 9.49 |
| dodecylbenzene | 8.61 |
| bis (2-ethylhexyl) azelate | 9.20 |
| trioctylphosphine oxide | 9.74 |
| dinonyl phthalate | 9.98 |
| didecyl phthalate | 11.04 |
| didodecyl phthalate | 13.15 |
| 3-(4-hydroxy-3,5-di-t-butylphenyl)-propionic acid, octadecyl ester | 14.07 |
| trioctyl amine | 10.76 |
| Monomer | |
| acrylic acid | 0.16 |
| isopropyl acrylamide | 0.20 |
| b-(hydroxyethyl) methacrylate | 0.25 |
| divinyl benzene | 3.59 |
| vinyl acetate | 0.59 |
| methyl acrylate | 0.75 |
| methyl methacrylate | 1.06 |
| ethyl acrylate | 1.28 |
| ethyl methacrylate | 1.59 |
| butyl acrylate | 2.33 |
| butyl methacrylate | 2.64 |

-continued

| | $\log P_{calc}$ |
|---|---|
| styrene | 2.89 |
| divinyl benzene | 3.59 |
| mixture of vinyl toluenes | 3.37 |
| 2-ethylhexyl acrylate | 4.32 |
| 2-ethylhexyl methacrylate | 4.62 |
| t-butylstyrene | 4.70 |

The hydrophobic compound is employed in an amount of at least about 0.01 to about 5, preferably at least about 0.05 to about 4 and most preferably at least about 0.5 to about 3 percent by weight based on the weight of the monomer. Hexadecane is particularly preferred.

In preferred embodiments of the invention the protective layer is an electrically conductive layer having a surface resistivity of less than $5\times10^{11}$ ohms/square. Such electrically conductive overcoat layers are described in U.S. Pat. No. 5,547,821, incorporated herein by reference. As taught in the '821 patent, electrically conductive overcoat layers comprise metal-containing particles dispersed in a polymeric binder in an amount sufficient to provide the desired surface resistivity. Examples of suitable electrically-conductive metal-containing particles for the purposes of this invention include:

(1) donor-doped metal oxide, metal oxides containing oxygen deficiencies, and conductive nitrides, carbides, and borides. Specific examples of particularly useful particles include conductive $TiO_2$, $SnO_2$, $V_2O_5$, $Al_2O_3$, $ZrO_2$, $In_2O_3$, ZnO, $ZnSb_2O_6TiB_2$, $ZrB_2$, $NbB_2$, $TaB_2$, $CrB_2$, MoB, WB, $LaB_6$, ZrN, TiN, TiC, WC, HfC, HfN, ZrC. Examples of the many patents describing these electrically-conductive particles include U.S. Pat. Nos. 4,275,103, 4,394,441, 4,416,963, 4,418,141, 4,431,764, 4,495,276, 4,571,361, 4,999,276, and 5,122,445;

(2) semiconductive metal salts such as cuprous iodide as described in U.S. Pat. Nos. 3,245,833, 3,428,451 and 5,075,171;

(3) a colloidal gel of vanadium pentoxide as described in U.S. Pat. Nos. 4,203,769, 5,006,451, 5,221,598, and 5,284,714; and (4) fibrous conductive powders comprising, for example, antimony-doped tin oxide coated onto non-conductive potassium titanate whiskers as described in U.S. Pat. Nos. 4,845,369 and 5,116,666.

A colloidal gel of vanadium pentoxide is especially useful for forming the electroconductive layer. Preferably, the vanadium pentoxide is doped with silver. The colloidal vanadium pentoxide gel typically consists of entangled, high aspect ration, flat ribbons about 50–100 angstroms wide, about 10 angstroms thick, and about 1000–10000 angstroms long. This unique morphology results in higher electrical conductivity than is typically observed for layers of similar thickness containing crystalline vanadium pentoxide particles. Low surface resistivities can be obtained with very low vanadium pentoxide coverages. This results in low optical absorption and scattering losses. Also, the coating containing the colloidal vanadium pentoxide gel is highly adherent to underlying support materials. Typically, the dry coating weight of vanadium pentoxide employed in the electroconductive layer is about 0.5 to 50 mg/m$^2$, preferably about 1 to 30 mg/m$^2$.

Conductive antimony-doped tin oxide particles are another preferred conductive agent which can be employed in the electroconductive layer. Typically, the mean diameter of these particles is about 200 nanometers or less, preferably the mean diameter is less than 100 nanometers. The dry coating weight of conductive tin oxide particles employed in the electroconductive layer is less than about 1 gram/$m^2$ to insure acceptable optical densities for the coating.

The thermally processable imaging element of this invention can be of the type in which an image is formed by imagewise heating of the element or of the type in which an image is formed by imagewise exposure to light followed by uniform heating of the element. The latter type of element is commonly referred to as a photothermographic element.

Typical photothermographic imaging elements within the scope of this invention comprise at least one image recording layer containing in reactive association in a binder, preferably a binder comprising hydroxyl groups, (a) photographic silver halide prepared in situ and/or ex situ, (b) an image-forming combination comprising (i) an organic silver salt oxidizing agent, preferably a silver salt of a long chain fatty acid, such as silver behenate, with (ii) a reducing agent for the organic silver salt oxidizing agent, preferably a phenolic reducing agent, and (c) an optional toning agent. References describing such imaging elements include, for example, U.S. Pat. Nos. 3,457,075; 4,459,350; 4,264,725 and 4,741,992 and *Research Disclosure*, June 1978, Item No. 17029.

The photothermographic element comprises a photosensitive component that consists essentially of photographic silver halide. In the photothermographic material it is believed that the latent image silver from the silver halide acts as a catalyst for the described image-forming combination upon processing. A preferred concentration of photographic silver halide is within the range of 0.01 to 10 moles of photographic silver halide per mole of silver behenate in the photothermographic material. Other photosensitive silver salts are useful in combination with the photographic silver halide if desired. Preferred photographic silver halides are silver chloride, silver bromide, silver bromochloride, silver bromoiodide, silver chlorobromoiodide, and mixtures of these silver halides. Very fine grain photographic silver halide is especially useful. The photographic silver halide can be prepared by any of the known procedures in the photographic art. Such procedures for forming photographic silver halides and forms of photographic silver halides are described in, for example, *Research Disclosure*, December 1978, Item No. 17029 and *Research Disclosure*, June 1978, Item No. 17643. Tabular grain photosensitive silver halide is also useful, as described in, for example, U.S. Pat. No. 4,435,499. The photographic silver halide can be unwashed or washed, chemically sensitized, protected against the formation of fog, and stabilized against the loss of sensitivity during keeping as described in the above Research Disclosure publications. The silver halides can be prepared in situ as described in, for example, U.S. Pat. No. 4,457,075, or prepared ex situ by methods known in the photographic art.

The photothermographic element typically comprises an oxidation-reduction image forming combination that contains an organic silver salt oxidizing agent, preferably a silver salt of a long chain fatty acid. Such organic silver salts are resistant to darkening upon illumination. Preferred organic silver salt oxidizing agents are silver salts of long chain fatty acids containing 10 to 30 carbon atoms. Examples of useful organic silver salt oxidizing agents are silver behenate, silver stearate, silver oleate, silver laurate, silver hydroxystearate, silver caprate, silver myristate, silver benzoate and silver palmitate. Combinations of organic silver salt oxidizing agents are also useful. An examples of a useful organic silver salt oxidizing agent that is not organic silver salt of a fatty acid is silver benzotriazole.

The optimum concentration of organic silver salt oxidizing agent in the photothermographic element will vary depending upon the desired image, particular organic silver salt oxidizing agent, particular reducing agent and particular photothermographic element. A preferred concentration of organic silver salt oxidizing agent is within the range of 0.1 to 100 moles of organic silver salt oxidizing agent per mole of silver halide in the element. When combinations of organic silver salt oxidizing agents are present, the total concentration of organic silver salt oxidizing agents is preferably within the described concentration range.

A variety of reducing agents are useful in the photothermographic element. Examples of useful reducing agents in the image-forming combination include substituted phenols and naphthols, such as bis-beta-naphthols; polyhydroxybenzenes, such as hydroquinones, pyrogallols and catechols; aminophenols, such as 2,4-diaminophenols and methylaminophenols; ascorbic acid reducing agents, such as ascorbic acid, ascorbic acid ketals and other ascorbic acid derivatives; hydroxylamine reducing agents; 3-pyrazolidone reducing agents, such as 1-phenyl-3-pyrazolidone and 4-methyl-4-hydroxymethyl-1-phenyl-3-pyrazolidone; and sulfonamidophenols and other organic reducing agents known to be useful in photothermographic elements, such as described in U.S. Pat. No. 3,933,508, U.S. Pat. No. 3,801,321 and *Research Disclosure*, June 1978, Item No. 17029. Combinations of organic reducing agents are also useful in the photothermographic element.

Preferred organic reducing agents in the photothermographic element are sulfonamidophenol reducing agents, such as described in U.S. Pat. No. 3,801,321. Examples of useful sulfonamidophenol reducing agents are 2,6-dichloro-4-benzene-sulfonamidophenol; 4-benzenesulfonamidophenol; and 2,6-dibromo-4-benzenesulfonamidophenol, and combinations thereof.

An optimum concentration of organic reducing agent in the photothermographic element varies depending upon such factors as the particular photothermographic element, desired image, processing conditions, the particular organic silver salt and the particular oxidizing agent.

The photothermographic element preferably comprises a toning agent, also known as an activator-toner or toner-accelerator. Combinations of toning agents are also useful in the photothermographic element. Examples of useful toning agents and toning agent combinations are described in, for example, *Research Disclosure*, June 1978, Item No. 17029 and U.S. Pat. No. 4,123,282. Examples of useful toning agents include, for example, phthalimide, N-hydroxyphthalimide, N-potassium-phthalimide, succinimide, N-hydroxy-1,8-naphthylamide, phthalazine, 1-(2H)-phthalazinone and 2-acetylphthalazinone.

Post-processing image stabilizers and latent image keeping stabilizers are useful in the photothermographic element. Any of the stabilizers known in the photothermographic art are useful for the described photothermographic element. Illustrative examples of useful stabilizers include photolytically active stabilizers and stabilizer precursors as described in, for example, U.S. Pat. No. 4,459,350. Other examples of useful stabilizers include azole thioethers and blocked azolinethione stabilizer precursors and carbamoyl stabilizer precursors, such as described in U.S. Pat. No. 3,877,940.

The thermally processable elements as described preferably contain various colloids and polymers alone or in combination as vehicles and binders and in various layers. Useful materials are hydrophilic or hydrophobic. They are transparent or translucent and include both naturally occurring substances, such as gelatin, gelatin derivatives, cellulose derivatives, polysaccharides, such as dextran, gum arabic and the like; and synthetic polymeric substances, such as water-soluble polyvinyl compounds like poly (vinylpyrrolidone) and acrylamide polymers. Other synthetic polymeric compounds that are useful include dispersed vinyl compounds such as in latex form and particularly those that increase dimensional stability of photographic elements. Effective polymers include water insoluble polymers of acrylates, such as alkylacrylates and methacrylates, acrylic acid, sulfoacrylates, and those that have cross-linking sites. Preferred high molecular weight materials and resins include poly(vinyl butyral), cellulose acetate butyrate, poly(methylmethacrylate), poly (vinylpyrrolidone), ethyl cellulose, polystyrene, poly (vinylchloride), chlorinated rubbers, polyisobutylene, butadiene-styrene copolymers, copolymers of vinyl chloride and vinyl acetate, copolymers of vinylidene chloride and vinyl acetate, poly(vinyl alcohol) and polycarbonates.

Photothermographic elements and thermographic elements as described can contain addenda that are known to aid in formation of a useful image. The photothermographic element can contain development modifiers that function as speed increasing compounds, sensitizing dyes, hardeners, antistatic agents, plasticizers and lubricants, coating aids, brighteners, absorbing and filter dyes, such as described in *Research Disclosure*, December 1978, Item No. 17643 and *Research Disclosure*, June 1978, Item No. 17029.

The thermally processable element can comprise a variety of supports. Examples of useful supports are poly (vinylacetal) film, polystyrene film, poly (ethyleneterephthalate) film, poly(ethylene naphthalate) film, polycarbonate film, and related films and resinous materials, as well as paper, glass, metal, and other supports that withstand the thermal processing temperatures.

The layers of the thermally processable element are coated on a support by coating procedures known in the photographic art, including dip coating, air knife coating, curtain coating or extrusion coating using hoppers. If desired, two or more layers are coated simultaneously.

Spectral sensitizing dyes are useful in the photothermographic element to confer added sensitivity to the element. Useful sensitizing dyes are described in, for example, *Research Disclosure*, June 1978, Item No. 17029 and *Research Disclosure*, December 1978, Item No. 17643.

A photothermographic element as described preferably comprises a thermal stabilizer to help stabilize the photothermographic element prior to exposure and processing. Such a thermal stabilizer provides improved stability of the photothermographic element during storage. Preferred thermal stabilizers are 2-bromo-2-arylsulfonylacetamides, such as 2-bromo-2-p-tolysulfonylacetamide; 2-(tribromomethyl sulfonyl)benzothiazole; and 6-substituded 2,4-bis (tribromomethyl)-s-triazines, such as 6-methyl or 6-phenyl-2,4-bis(tribromomethyl)-s-triazine.

The thermally processable elements are exposed by means of various forms of energy. In the case of the photothermographic element such forms of energy include those to which the photographic silver halides are sensitive and include ultraviolet, visible and infrared regions of the electromagnetic spectrum as well as electron beam and beta radiation, gamma ray, x-ray, alpha particle, neutron radiation and other forms of corpuscular wave-like radiant energy in either non-coherent (random phase) or coherent (in phase) forms produced by lasers. Exposures are monochromatic, orthochromatic, or panchromatic depending upon the spectral sensitization of the photographic silver halide. Imagewise exposure is preferably for a time and intensity sufficient to produce a developable latent image in the photothermographic element.

After imagewise exposure of the photothermographic element, the resulting latent image is developed merely by overall heating the element to thermal processing temperature. This overall heating merely involves heating the photothermographic element to a temperature within the range of about 900° C. to 180° C. until a developed image is formed, such as within about 0.5 to about 60 seconds. By increasing or decreasing the thermal processing temperature a shorter or longer time of processing is useful. A preferred thermal processing temperature is within the range of about 100° C. to about 140° C.

In the case of a thermographic element, the thermal energy source and means for imaging can be any imagewise thermal exposure source and means that are known in the thermographic imaging art. The thermographic imaging means can be, for example, an infrared heating means, laser, microwave heating means, resistive heating means or the like.

Heating means known in the photothermographic and thermographic imaging arts are useful for providing the desired processing temperature for the exposed photothermographic element. The heating means is, for example, a simple hot plate, iron, roller, heated drum, microwave heating means, heated air or the like.

Thermal processing is preferably carried out under ambient conditions of pressure and humidity. Conditions outside of normal atmospheric pressure and humidity are useful.

The components of the thermally processable element can be in any location in the element that provides the desired image. If desired, one or more of the components can be in one or more layers of the element. For example, in some cases, it is desirable to include certain percentages of the reducing agent, toner, stabilizer and/or other addenda in the overcoat layer over the photothermographic image recording layer of the element. This, in some cases, reduces migration of certain addenda in the layers of the element.

It is necessary that the components of the imaging combination be "in association" with each other in order to produce the desired image. The term "in association" herein means that in the photothermographic element the photographic silver halide and the image forming combination are in a location with respect to each other that enables the desired processing and forms a useful image.

The following examples illustrate the reduction of agglomeration of matte particles in an aqueous medium containing poly(vinyl alcohol) if a compound of formula I or formula II is added.

EXAMPLE 1

Matte Agglomeration

Two batches of poly(vinyl alcohol) (Elvanol 52/22, E. I. DuPont de Nemours Co.) in an aqueous medium containing a poly(vinyl alcohol) concentration of 7% were prepared and designated Sample 1 and Sample 2. To Sample 1, was added a 75:25 mixture of compounds of Ia and Ib in an amount to form a composition containing 15 ppm of the mixture of these compounds.

Matte particles were prepared according to Preparation 6 of U.S. Pat. No. 5,563,226, the disclosure of which is incorporated herein by reference. A 24.5% solids dispersion of matte particles ( 0.17 g) were diluted with 9.6 g of distilled water at 34° C. and held for 5 minutes. The poly(vinyl alcohol) solution to be tested (5.5 g) was added and mixed at room temperature for 1 minute.

The dispersions were evaluated using an optical microscope (Olympus Model BH-2), a color digital converter (Hitachi KP-D50), a color printer (Kodak 450GL) and a color monitor (Sony). The evaluation of the test samples is given in Table I.

Bacterial and Fungal Growth

Two samples of poly(vinyl alcohol). Sample 1 contained a mixture of compounds Ia and Ib and Sample 2 did not.

The samples were diluted with sterile high purity water and filtered through 0.45 $\mu$m filters to retain bacteria or fungus from the samples. The samples were plated on Sabouraud Dextrose Nutrient Agar plates and incubated for several days and 28–29° C. The filters were then evaluated for bacterial or fungal growth. The samples were held at room temperature and tested initially, and at the end of 1 month, 2 month, 3 month and 4 month intervals for bacterial and fungal levels. The results are shown in Table I.

TABLE I

Evaluation of Matte Agglomeration and Evaluation of Bacterial and Fungal Growth

| | Agglomeration | | | | |
|---|---|---|---|---|---|
| PVA Sample | Initial | 1 month | 2 months | 3 months | 4 months |
| 1 | no agglomerates | some doublets | some doublets | | some doublets |
| 2 | no agglomerates | some doublets | many agglomerates 2–10 μm in size | | large agglomerates up to 50 μm in size |
| | Bacterial Growth Colony Forming Units/mL | | | | |
| PVA Sample | initial | 1 month | 2 month | 3 month | 4 month |
| 1 | <10 | 10 | <10 | <10 | <10 |
| 2 | 100 | 1.3E6 | 6.2E5 | 5.3E5 | 1.8E5 |
| | Fungal Colony Forming Units/mL | | | | |
| PVA Sample | initial | 1 month | 2 month | 3 month | 4 month |
| 1 | <10 | <10 | <10 | <10 | <10 |
| 2 | 40 | <10 | <10 | <10 | <10 |

EXAMPLE 2

Samples were prepared as set forth in Example 1. Samples 2-1 and 2-2 contained a mixture of compounds Ia and Ib and Samples 2-3 and 2-4 did not. The solutions were evaluated under a microscope.

The above poly (vinyl alcohol) solutions were aged for 4 months, then made into overcoat solutions as in Example 3, below. These overcoat solutions were coated on top of a photothermographic imaging layer as in Example 3 and the appearance of the coated films were evaluated. Results are given in Table II.

TABLE II

Evaluation of Matte Agglomeration in PVA Dispersion and Appearance of Film coated with the Dispersion

| | Microscopic Appearance of PVA/Matte Dispersion | | |
|---|---|---|---|
| Sample | less than 24 hrs at RT | 3 days at RT | Appearance of Coated Film |
| 2-1 | some agg. up to 10 μm | some agg. up to 10 μm | acceptable |
| 2-2 | few small agg. <5 μm | few small agg. <5 μm | acceptable |
| 2-3 | some agg. up to 10 μm | some agg. up to 25 μm | unacceptable |
| 2-4 | some agg. up to 50 μm | some agg. up to 50 μm | unacceptable |

These results show that if a composition containing poly(vinyl alcohol) contains agglomerated matte particles an unacceptable coating is obtained, while if compounds of formula I or II are present the coating is acceptable.

EXAMPLE 3

This example illustrates that addition of a mixture of compounds Ia and Ib over various concentration levels does not adversely affect sensitometry of a photothermographic element in which the overcoat layer contains a mixture of compounds Ia and Ib.

A photothermographic element was prepared having the following composition:

| | mg/ft2(g/m$^2$) |
|---|---|
| OVERCOAT | |
| Polyvinyl alcohol (Elvanol 52/22, E.I.DuPont de Nemours Co.) | 68.0 (0.748) |
| Poly(silicic acid) (PSA, see US4,741,992) | 107.4 (1.18) |
| Matte (Prep. 6 of US5,563,226) | 7.1 (0.078) |
| Surfactant (10G from Olin Corp.) | 2.9 (0.032) |
| Blue Filter Dye (Victoria Blue BO, Aldrich Chemical Co.) | 1.3 (0.014) |
| PHOTOTHERMOGRAPHIC LAYER | |
| Silver behenate (Ag) | 107.0 (1.18) |
| AgBr (Ag) | 22.0 (0.24) |

-continued

| | mg/ft2(g/m$^2$) |
|---|---|
| NaI | 4.9 (0.054) |
| Succinimide, toner/developer accelerator | 23.1 (0.25) |
| Surfactant (SF-96) (a polysiloxane, General ElectricCo.) | 0.4 (0.004) |
| Stabilizer, 2-Bromo-2-(p-tolylsulfonyl) acetamide) | 6.3 (0.069) |
| Photobleach,2,4-Bis(trichloromethyl)-6-(1-naphtho)-s-triazine) | 1.5 (0.017) |
| Palmitic acid | 10.0 (0.11) |
| Poly(vinylbutyral) binder, (Butvar-76, Monsanto Co.) | 424.0 (4.66) |
| Sensitizing dye | 0.6 (0.007) |
| 4-Benzenesulfonamidophenol developer | 133.0 (1.46) |
| 4-Methyl-2-pentanone solvent | 45.0 (0.50) |
| SUPPORT - 4 mil blue poly(ethylene terephthalate) film | |

In the following example, only the composition of the overcoat layer was varied. The composition of the remainder of the film was constant and as described above. Identical films were prepared as above, the only differences being in the overcoat layers in which the presence and concentration of a 75:25 mixture of compounds Ia and Ib varied as shown in the following Table III and the presence or absence of the dye Victoria Pure Blue BO varied as shown in Table III. The overcoat layers were examined for cracks and none were found.

The overcoat dispersions were examined for agglomeration as set forth in Example 1.

The coatings were exposed on an EG&G sensitometer equipped with a xenon flash lamp having a 10–3 sec exposure time, through a step wedge. Immediately after exposure step, the films were heat processed an 119° C. for five seconds. The negative images on each film were evaluated on a densitometer using Status A, blue filtration. The sensitometry for each sample is recorded in Table III for strips incubated for 4 weeks at 120° F. (49° C.) at 15% relative humidity.

TABLE III

| Sample | Cpds Ia&Ib (ppm) | Blue Dye | Matte Agglomeration[1] | Relative Red Speed | Dmax | Dmin |
|---|---|---|---|---|---|---|
| 3-1 | 0 | no | good | 0.81 | 2.83 | .10 |
| 3-2 | 15 | no | good | 0.95 | 2.82 | .09 |
| 3-3 | 91.9 | no | good | 1.00 | 2.85 | .11 |
| 3-4 | 162 | no | good | 0.95 | 3.05 | .08 |
| 3-5 | 1510 | no | few agglomerates | 0.83 | 2.67 | .10 |
| 3-6 | 0 | yes | good | 0.63 | 2.78 | .09 |
| 3-7 | 15 | yes | good | 0.59 | 2.70 | .11 |
| 3-8 | 91.9 | yes | good | 0.62 | 2.79 | .09 |
| 3-9 | 162 | yes | good | 0.59 | 2.64 | .11 |
| 3-10 | 1510 | yes | few agglomerates | 0.60 | 2.61 | .10 |

[1]evaluated as described in Example 1.

The data in Table III show that the presence of a mixture of compounds Ia and Ib does not adversely affect sensitometry of photothermographic films.

The invention has been described in detail, with particular reference to certain preferred embodiments thereof, but it should be understood that variations and modifications can be effected within the spirit and scope of the invention.

What is claimed is:

1. A method of making a thermally processable imaging element comprising:

i) forming an aqueous medium by dissolving poly(vinyl alcohol) in water;

ii) adding a compound of formula I or formula II to the aqueous medium;

(I)

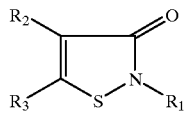

wherein:

$R_1$, represents a hydrogen atom, a straight or branched chain alkyl group, a cyclic alkyl group, an alkenyl group, an aralkyl group, an aryl group, a heterocyclic group an alkylamido group, an arylamido group, and alkylthioamido group, an arylamido group, an alkyl sulfamido group, an arylsulfamido group and $R_2$, and $R_3$, each independently represents a hydrogen atom, a halogen atom, an alkyl group, a cyclic alkyl group an aryl group, a cyano group, an alkylthio group, an aryl thio group, an alkylsulfoxide group an alkylsulfonyl group or a heterocyclic group;

(II)

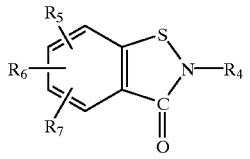

wherein:

$R_4$, is a hydrogen atom, an alkyl group or an alkoxy group; and $R_5$, $R_6$ and $R_7$ each represents a hydrogen atom, a halogen atom, an alkyl group, an alkoxy group, a cyano group or a nitro group;

iii) adding matte particles to the aqueous medium;

iv) coating an image recording layer onto one side of a support; and v) coating the aqueous medium containing the matte particles as an overcoat layer over the image recording layer or as backing layer on the side of the support opposite the image recording layer;

wherein the compound of formula I or formula II is present in the aqueous medium in an amount sufficient to inhibit agglomeration of the matte particles.

2. A method according to claim 1, wherein the aqueous medium contains a compound of formula (I).

3. A method according to claim 2, wherein the compound of formula I is of formula Ia or Ib:

(Ia)

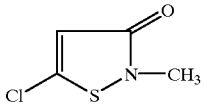

(Ib)

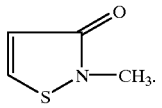

4. A method according to claim 3, wherein the composition contains a compound of formula Ia and a compound of formula Ib.

5. A method according to claim 4, wherein the ratio between the compound Ia and the compound of formula Ib is 50:50 to 90:10.

6. A method according to claim 5, wherein the ratio between the compound Ia and the compound of formula Ib is 75:25.

7. A method according to claim 1, wherein the matte particles comprise poly(methyl methacrylate).

8. A method according to claim 1, wherein the matte particles comprise poly(methyl methacrylate) particles polymerized in the presence of gelatin.

9. A method according to claim 1, wherein each matte particle comprises a core of poly(methyl methacrylate) surrounded by particles of colloidal silica.

10. A method according to claim 2, wherein the compound of formula I is present in an amount of about 1 to about 1500 ppm, relative to the amount of poly(vinyl alcohol).

11. An imaging element comprising (1) a support;

(2) an image recording layer on one side of the support;

(3) a layer on the same side of the support as the image recording layer or on the opposite side of the support, said layer comprising:

(a) a poly(vinyl alcohol) binder;

(b) polymeric matte particles; and (c) a compound of formula I or formula II:

(I)

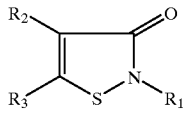

wherein:

$R_1$, represents a hydrogen atom, a straight or branched chain alkyl group, a cyclic alkyl group, an alkenyl group, an aralkyl group, an aryl group, a heterocyclic group an alkylamido group, an arylamido group, and alkylthioamido group, an arylamido group, an alkyl sulfamido group, an arylsulfamido group and $R_2$, and $R_3$, each independently represents a hydrogen atom, a halogen atom, an alkyl group, a cyclic alkyl group an aryl group, a cyano group, an alkylthio group, an aryl thio group, an alkylsulfoxide group an alkylsulfonyl group or a heterocyclic group;

(II)

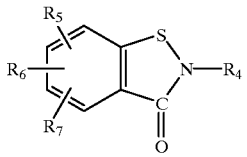

wherein:

$R_4$, is a hydrogen atom, an alkyl group or an alkoxy group; and $R_5$, $R_6$ and $R_7$ each represents a hydrogen atom, a halogen atom, an alkyl group, an alkoxy group, a cyano group or a nitro group.

12. An imaging element according to claim 11, wherein the aqueous medium contains a compound of formula (I).

13. An imaging element according to claim 12, wherein the compound of formula I is of formula Ia or Ib (Ia)

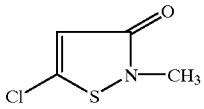

(Ib)

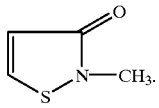

14. An imaging element according to claim 13, wherein the composition contains a compound of formula Ia and a compound of formula lb.

15. An imaging element according to claim 14, wherein the ratio between the compound Ia and the compound of formula Ib is 50:50 to 90:10.

16. An imaging element according to claim 15, wherein the ratio between the compound Ia and the compound of formula Ib is 75:25.

17. An imaging element according to claim 11, wherein the matte particles comprise poly(methyl methacrylate).

18. An imaging element according to claim 11, wherein the matte particles comprise poly(methyl methacrylate) particles polymerized in the presence of gelatin.

19. An imaging element according to claim 11, wherein each matte particle comprises a core of poly(methyl methacrylate) surrounded by particles of colloidal silica.

20. A composition comprising:

(i) an aqueous medium comprising water and dissolved therein poly(vinyl alcohol); and (ii) polymeric matte particles dispersed in said aqueous medium;

wherein the aqueous medium further comprises:

(iii) a compound of formula I or formula II in an amount sufficient to inhibit agglomeration of the matte particles:

(I)

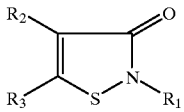

wherein:

$R_1$, represents a hydrogen atom, a straight or branched chain alkyl group, a cyclic alkyl group, an alkenyl group, an aralkyl group, an aryl group, a heterocyclic group an alkylamido group, an arylamido group, and alkylthioamido group, an arylamido group, an alkyl sulfamido group, an arylsulfamido group and $R_2$, and $R_3$, each independently represents a hydrogen atom, a halogen atom, an alkyl group, a cyclic alkyl group an aryl group, a cyano group, an alkylthio group, an aryl thio group, an alkylsulfoxide group an alkylsulfonyl group or a heterocyclic group;

(II)

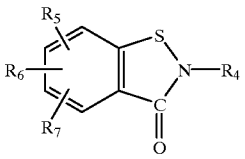

wherein:

$R_4$, is a hydrogen atom, an alkyl group or an alkoxy group; and $R_5$, $R_6$ and $R_7$ each represents a hydrogen atom, a halogen atom, an alkyl group, an alkoxy group, a cyano group or a nitro group.

21. A composition according to claim 20, wherein the aqueous medium contains a compound of formula (I).

22. A composition according to claim 21, wherein the compound of formula I is of formula Ia and Ib:

(Ia)

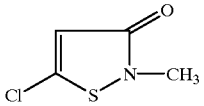

-continued (Ib)

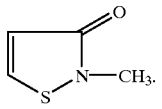

23. A composition according to claim 22, wherein the composition contains a compound of formula Ia and a compound of formula lb.

24. A composition according to claim 23, wherein the ratio of the compound Ia to the compound of formula Ib is 50:50 to 90:10.

25. A composition according to claim 24, wherein the ratio of the compound Ia to the compound of formula Ib is 75:25.

26. A composition according to claim 20, wherein the matte particles comprise poly(methyl methacrylate).

27. A composition according to claim 20, wherein the matte particles comprise poly(methyl methacrylate) particles polymerized in the presence of gelatin.

28. A composition according to claim 20, wherein each matte particles comprise a core of poly(methyl methacrylate) surrounded by particles of colloidal silica.

29. A composition according to claim 21, wherein the compound of formula I is present in an amount of about 1 to about 1500 ppm, relative to the amount of poly(vinyl alcohol).

* * * * *